US007026769B2

(12) United States Patent
Lee et al.

(10) Patent No.: US 7,026,769 B2
(45) Date of Patent: Apr. 11, 2006

(54) LUMINARY CONTROL SYSTEM ADAPTED FOR REPRODUCING THE COLOR OF A KNOWN LIGHT SOURCE

(76) Inventors: Joon Chok Lee, 37, Jalan Loh Poh Heng, 11200 Penang (MY); Kee Yean Ng, 6 Halaman Kikik, Taman Inderawaslh, 13600 Prai, Penang (MY); Heng Yow Cheng, 18 Lebuh Batu Maung 12, 11960 Bayan Lepas, Ponang (MY)

( * ) Notice: Subject to any disclaimer, the term of this patent is extended or adjusted under 35 U.S.C. 154(b) by 0 days.

(21) Appl. No.: 10/741,245

(22) Filed: Dec. 18, 2003

(65) Prior Publication Data

US 2005/0134197 A1 Jun. 23, 2005

(51) Int. Cl.
*G05F 1/00* (2006.01)
*H05B 37/02* (2006.01)

(52) U.S. Cl. ..... 315/291; 315/307

(58) Field of Classification Search ..... 315/291, 315/293, 300, 304, 307, 244
See application file for complete search history.

(56) References Cited

U.S. PATENT DOCUMENTS 6,552,495 B1 4/2003 Chang ..... 315/169.3
6,717,376 B1 * 4/2004 Lys et al. ..... 315/292
6,753,661 B1 * 6/2004 Muthu et al. ..... 315/307
6,777,891 B1 * 8/2004 Lys et al. ..... 315/291
6,781,329 B1 * 8/2004 Mueller et al. ..... 315/297
6,793,374 B1 * 9/2004 Begemann ..... 362/294
6,801,003 B1 * 10/2004 Schanberger et al. ..... 315/291
2002/0071279 A1 * 6/2002 Katogi et al. ..... 362/317
2003/0137258 A1 * 7/2003 Piepgras et al. ..... 315/291

OTHER PUBLICATIONS

WO 2004/057923 A1 -Zwanenburg, et al—Jul. 8, 2004.

* cited by examiner

*Primary Examiner*—Thuy V. Tran
*Assistant Examiner*—Minh Dieu A

(57) ABSTRACT

A light source and method for programming the light source to provide a color that approximates that of a target light source are disclosed. The light source generates light at first and second wavelengths with intensities that are determined by first and second control signals that are set by a feedback controller that matches the outputs of a monitoring circuit to target signals. The target signals are generated from target values that are entered into the feedback controller by exposing the light source to the target light source and observing the outputs from a set of photodetectors incorporated in the light source. In one embodiment, the photodetectors in the monitoring circuit are used for this programming function.

15 Claims, 3 Drawing Sheets

LUMINARY CONTROL SYSTEM ADAPTED FOR REPRODUCING THE COLOR OF A KNOWN LIGHT SOURCE

FIELD OF THE INVENTION

The present invention relates to light sources, and more particularly, to light sources that are designed to replace an existing light source.

BACKGROUND OF THE INVENTION

Light emitting diodes(LEDs) are attractive candidates for replacing conventional light sources such as incandescent lamps and fluorescent light sources. The LEDs have higher light conversion efficiencies and longer lifetimes. Unfortunately, LEDs produce light in a relatively narrow spectral band. Hence, to produce a light source having an arbitrary color, a compound light source having multiple LEDs is typically utilized. For example, an LED-based light source that provides an emission that is perceived as matching a particular color can be constructed by combining light from red, blue, and green emitting LEDs. The ratios of the intensities of the various colors sets the color of the light as perceived by a human observer.

Unfortunately, the output of the individual LEDs varies with temperature, drive current, and aging. In addition, the characteristics of the LEDs vary from production lot to production lot in the manufacturing process and are different for different color LEDs. Hence, a light source that provides the desired color under one set of conditions will exhibit a color shift when the conditions change or the device ages. To avoid these shifts, some form of feedback system must be incorporated in the light source to vary the driving conditions of the individual LEDs such that the output spectrum remains at the design value in spite of the variability in the component LEDs used in the light source.

Typically, a prior art light source having a feedback system for maintaining the color perceived by a human observer at a predetermined hue is constructed from a plurality of LEDs that emit light at different wavelengths. A photodetector that includes an appropriate filter is used to measure the light that is generated from each LED. The output of the photodetector is compared to a target value to generate an error signal that is used to adjust the light output of the corresponding LED.

Each target value is a function of the desired light intensity in the corresponding spectral band and of the particular light conversion characteristics of the photodiode that generated the light intensity signal. Hence, even if the circuit designer knows the desired ratio of colors in a light source, the designer must still calibrate the feedback system to take into account the characteristics of the photodiodes. To aid the designer in this regard, prior art systems have been proposed that provide a tricolor light source with inputs that have been pre-calibrated in terms of some standard colorometric system such as the CIE standard.

While such feedback schemes significantly reduce the variability problems discussed above, they require that the circuit designer determine the target values that will generate the desired light spectrum. Consider a circuit designer who is faced with the problem of designing a tricolor LED-based light source to replace a particular incandescent source. The designer must determine the red, green, and blue target values that will provide a spectrum that matches the color of the target light spectrum as perceived by a human observer. If the designer is using a calibrated tricolor light source such as the ones discussed above, the designer must still measure the particular incandescent source in a standard spectrometer to determine the standard values for the target values. Such measurements require specific expertise and increase the cost and product design cycle time.

SUMMARY OF THE INVENTION

The present invention includes a light source and method for programming the light source to provide a spectrum that approximates the color of a target light source. The light source has a light generator that generates a first light signal of a first wavelength and a first intensity that is set by a first control signal and a second light signal at a second wavelength and a second intensity that is set by a second control signal. The light source utilizes a light monitor that generates a first monitor signal having an amplitude determined by the first intensity and a second monitor signal having an amplitude determined by the second intensity. A target signal generator having a port for receiving a target light signal is used to generate a first target signal having an amplitude indicative of a first target value and a second target signal having an amplitude indicative of a second target value from the target light signal. A feedback controller generates the first and second control signals such that the first and second monitor signals have a fixed relationship to the first and second target signals, respectively. In one embodiment, the light generator utilizes LEDs. In another embodiment, the light generator utilizes lasers. In yet another embodiment, the light monitor includes a first monitor photodetector that generates a signal having a first functional relationship to the intensity of light received by the first monitor photodetector at the first wavelength, and the target signal generator includes a first target photodetector that generates a signal having the first functional relationship to the intensity of light received by the first target photodetector at the first wavelength. In another embodiment, the first monitor photodetector and the first target photodetector comprise identical optical filters for blocking at least a portion of light of the second wavelength from reaching the first monitor photodetector and the first target photodetector. In yet another embodiment, the feedback controller includes a memory for storing the first and second target values, the feedback controller causing the first and second target values to be generated from the target light signal and stored in the memory in response to a calibration control signal being received by the feedback controller. In another embodiment, the target signal generator port is positioned so as to cause the target light signal to illuminate the light monitor. In this embodiment, the target signal generator causes the feedback controller to generate the first and second target values from the first and second monitor signals and to store the first and second target values in the memory during a period of time in which the light generator is not generating light.

DETAILED DESCRIPTION OF THE PREFERRED EMBODIMENTS OF THE INVENTION

Figure 1:
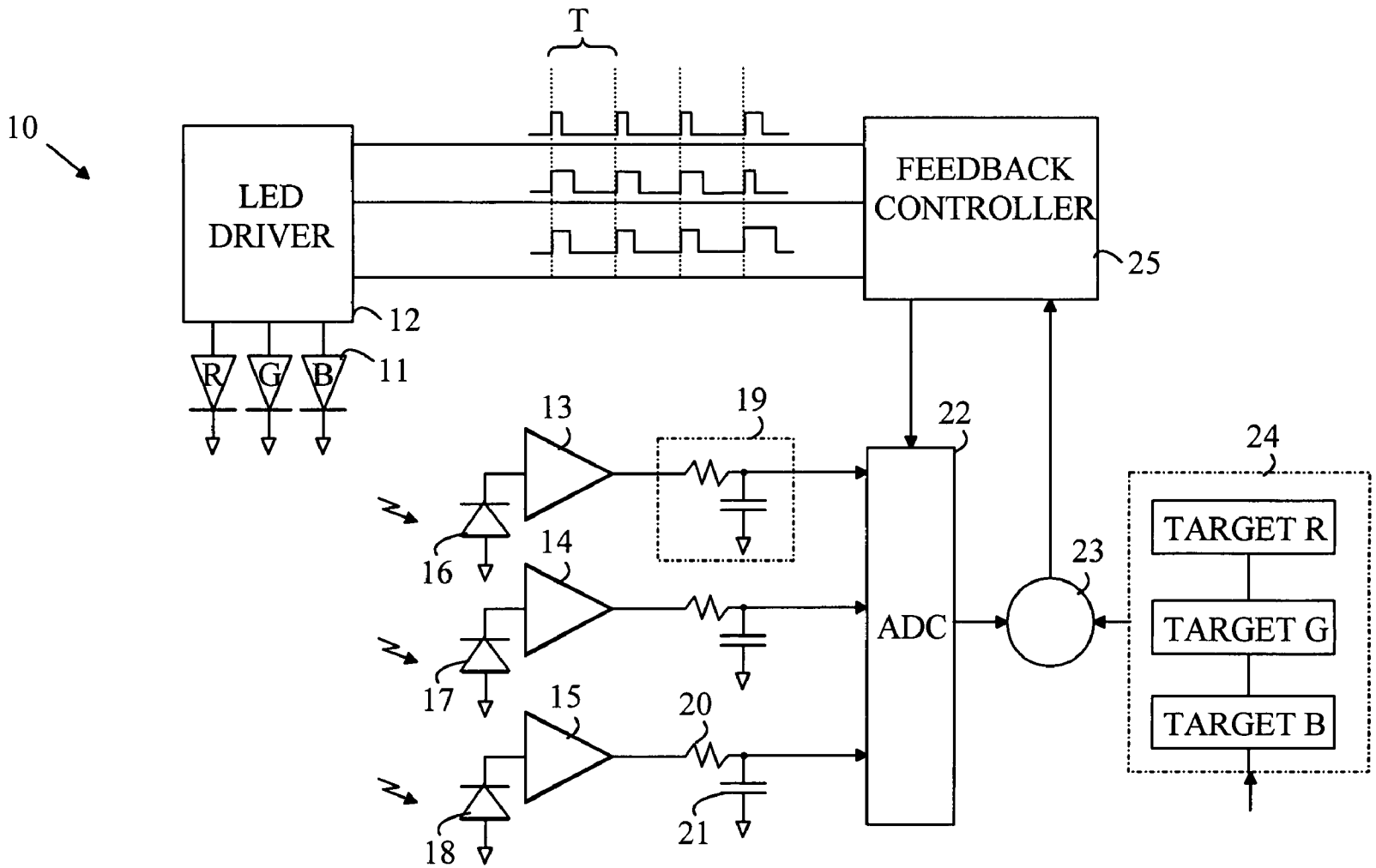
FIGURE 1 (PRIOR ART)
FIG. 1 is a block diagram of a prior art LED light source that utilizes a feedback system to control the duty factor of the individual LEDs to produce a precise output color.

The manner in which the present invention provides its advantages can be more easily understood with reference to FIG. 1. FIG. 1 is a block diagram of a prior art LED light source that utilizes a feedback system to control the duty factor of the individual LEDs to produce a precise output color. Light source 10 utilizes red, green, and blue LEDs 11 to generate light of an arbitrary color. The LEDs are driven by a driver 12 that sets the current through each LED when that LED is "on". In the "on" state, each LED is driven with a predetermined current that is independent of the color being generated by light source 10. The LEDs are driven in a pulsed manner with a cycle time having a period T. During each period, each of the LEDs is turned on for a time t that depends on the color of light that is to be generated by light source 10.

To simplify the following discussion the ratio t/T will be referred to as the duty factor. In principle, the intensity of light as seen by a human observer from each of the LEDs is proportional to t for that LED, provided the period T is sufficiently small. Unfortunately, the LEDs do not turn on and off instantaneously and the light output from any LED may also be a function of the duty factor, since the operating temperature of the LED will increase with increasing duty factors. However, there is a fixed relationship between the desired output color and the duty factors applied to the three LEDs. The relationship is determined continuously by measuring the light that is actually generated and adjusting the duty factors using a servo loop.

Referring again to FIG. 1, light source 10 includes three photodetectors 16–18 that receive a portion of the light leaving the LEDs. Each of the photodetectors ideally measures the light intensity in a wavelength band as described by CIE 1931 tristimulus functions.

Each photodetector has a corresponding interface circuit that matches the signal from the corresponding photodetector to a low pass filter. The interface circuits corresponding to photodetectors 16–18 are shown at 13–15, respectively. An exemplary low pass filter is shown at 19. Each low pass filter consists of a resistor 20 and a capacitor 21. The resistor and capacitor values are chosen to average out the on and off cycles such that the outputs of the low pass filters are DC levels representing the intensity of light in each of the three wavelength bands. The outputs of the low pass filters are digitized using ADC 22 and compared to target values that are stored in a register stack 24 in a subtraction circuit 23. The target values represent the three intensities corresponding to the desired output color. The differences between the measured intensities and target intensities provide three error signals that are used by feedback controller 25 to adjust the three corresponding duty factors until the measured output matches the target values.

Figure 2:
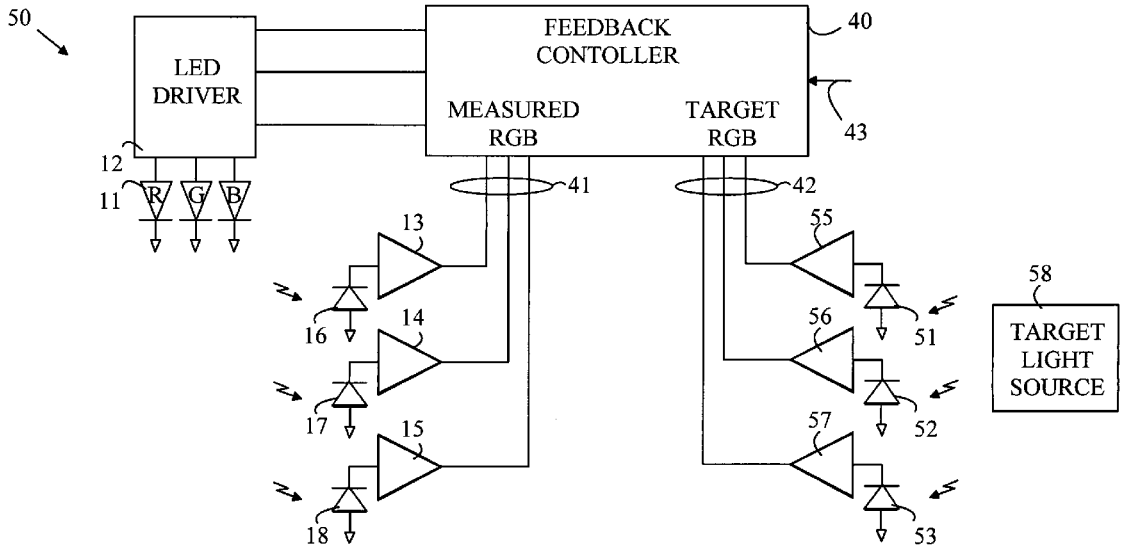
FIG. 2 is a block diagram of a light source according to one embodiment of the present invention.

Refer now to FIG. 2, which is a block diagram of a light source 50 according to one embodiment of the present invention. To simplify the following discussion, those elements that provide functions analogous to those discussed above with reference to FIG. 1 have been given the same numeric designations as used in FIG. 1 and will not be discussed in detail here. Light source 50 utilizes a feedback controller 40 that accepts a set of target red, green, and blue (RGB) values that are compared to the red, green, and blue values provided by photodiodes 16–18 and their associated drive circuits. These values can be considered as the tristimulus values in a new arbitrary colormetric system.

To simplify the following discussion, the circuitry for generating the error signals from the target and measured photodiode outputs has been included in feedback controller 40. Since feedback controllers are known in the art, the details of this circuitry will not be discussed in detail here. For the purposes of this discussion, it is sufficient to note that feedback controller 40 adjusts the drive signals to LEDs 11 such that the measured RGB values input to feedback controller 40 on port 41 match, respectively, the target RGB values input on port 42. For the purposes of this discussion, it will be assumed that the measured RGB values and target RGB values are analog signals.

As noted above, one problem encountered in designing an LED light source to match a particular existing target light source is determining the correct values for the target RGB values. The correct target RGB values are a function both of the desired red, green and blue LEDs light intensities and of the photodiodes used to monitor the output of the LEDs. In principle, the feedback controller can be calibrated such that the user can determine the correct target RGB values from a knowledge of the RGB values for the existing light source. This requires the user to calibrate the existing light source in terms of the standards used to calibrate the feedback controller. This approach places a burden on the circuit designer. In addition, each light source must be calibrated to take into account differences in the LEDs.

The present invention avoids these problems by providing an input system for the target RGB values that utilizes the existing target light source that is being matched by the LED light source. In the present invention, the target RGB inputs are generated by a set of photodiodes and interface circuits that are matched to photodiodes 16–18 and their interface circuits. The photodiodes used to provide the target RGB values are shown at 51–53, and the corresponding interface circuits are shown at 55–57. These photodiodes will be referred to as the target photodiodes in the following discussion and photodiodes 16–18 will be referred to as the feedback photodiodes. There is one target photodiode for each feedback photodiode. For example, the target photodiode that measures light in the red region of the spectrum has the same light spectral filter and light conversion efficiency as the feedback photodiode used to measure the light generated by the red LED.

To match a light source 58, the source is used to illuminate the target photodiodes 51–53. Since each target photodiode has been chosen to match the corresponding feedback photodiode, the signals generated by the target photodiodes are the correct target RGB target values to replicate the color of light source 58. Hence, the circuit designer does not need to calibrate the target light source or utilize an LED light source that has been calibrated in terms of some standard system such as the CIE standard.

Once the target values have been generated, light source 58 can be removed provided feedback controller 40 includes a non-volatile memory in which the target values are stored. In such an embodiment, feedback controller 40 includes an externally accessible port 43 for receiving a signal that causes feedback controller 40 to store a set of target values that are determined by those input on port 42. The stored target values can be stored as digital values derived from the analog target values or as analog values. In this regard, it should be noted that non-volatile memories for storing analog values are well known in the art. The present invention can also replicate a target light source at a remote location continuously such that the light source can mimic all the changes of the target light source in real time.

The above-described embodiments of the present invention store one set of target values that provide the color match to one target light source. However, embodiments in which the feedback controller stores multiple sets of target values corresponding to a variety of light sources can also be constructed by exposing the target photodiodes to each of the light sources and storing the resulting target values. The light source can then be used to provide a color match for any of the target light sources by selecting the desired set of target values. In such an embodiment, the feedback controller would include an input for specifying which set of target values to use. This input can be provided by a user or by a programming device that is attached to the light source. Furthermore, a sequence of target values can be utilized to provide a color pattern that changes as a function of time. The various control signals can be input through port 43 discussed above.

It should be noted that the present invention can also be used to replicate the color of a target light source that is remote to the LEDs in a continuous manner in real time. In such an embodiment, the target photodiodes would be located at the target light source and the output values of these photodiodes would be transmitted to the feedback controller.

The above-described embodiments utilize monitor and target photodiodes that are matched. If this condition is not met, a calibration procedure can be utilized. For example, assume that the target photodiode that measures light in the red region has a different light spectral filter and light conversion efficiency than the corresponding feedback photodiode. Both the target photodiode and feedback photodiode can be calibrated by exposing both photodiodes to the same light source at various intensities and recording the outputs of both photodiodes. These calibration values can be stored in non-volatile memory in the feedback controller so that the feedback controller can correct for differences in the target and monitor photodiodes during the feedback cycle by computing the target signal that would have been generated if the target and monitor photodiodes were matched.

Figure 3:
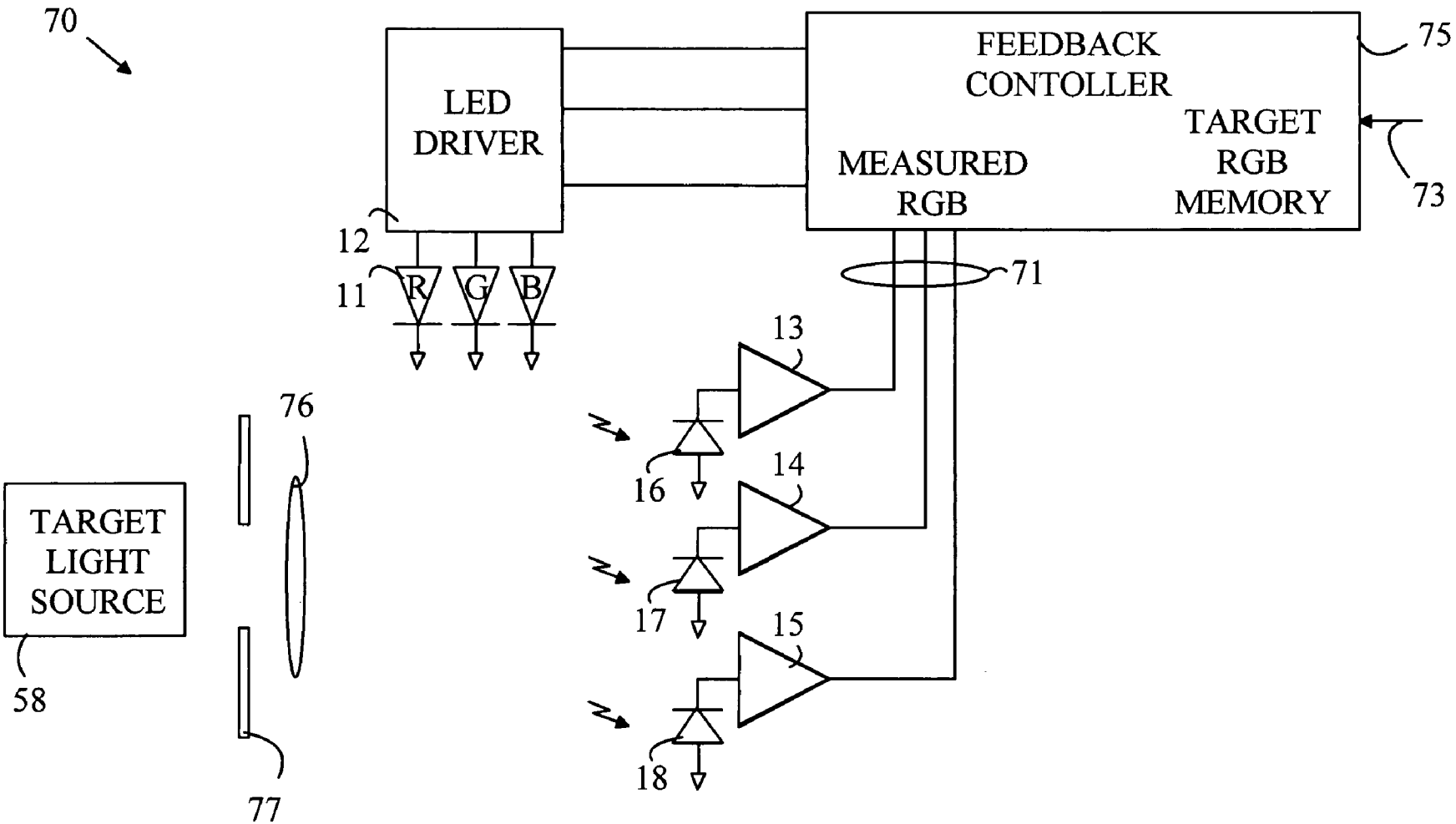
FIG. 3 is a schematic drawing of another embodiment of the present invention in which the feedback photodiodes are also used to generate the target values for the feedback controller.

The above-described embodiments utilize a separate set of photodiodes for generating the target values from a light source whose spectrum is to be used to set the output of the LEDs in the light source. However, it should be noted that embodiments in which the feedback photodiodes are used for both functions can also be constructed. Refer now to FIG. 3, which is a schematic drawing of another embodiment of the present invention in which the feedback photodiodes are also used to generate the target values for the feedback controller. To simplify the discussion, those elements of light source 70 that perform functions analogous to those described in FIG. 2 have been given the same numeric designations as used in FIG. 2 and will not be discussed further here. Light source 70 includes an aperture 77 that is positioned to receive light from the target source during a calibration phase. An optical imaging system 76 may be included to assure that the light from target light source 58 illuminates feedback photodiodes 16–18 uniformly.

When a predetermined signal is applied to port 73, feedback controller 75 reads the values on port 71 and stores information specifying these values in a target RGB memory within feedback controller 75. After the feedback controller is properly programmed, target light source 58 is removed and aperture 77 closed to prevent light from reaching the feedback photodiodes from sources outside of light source 70 during normal operation.

The above-described embodiments of the present invention utilize 3 LEDs as the light generator. However, embodiments of the present invention that utilize different numbers of LEDs can also be constructed. As long as the photodetectors are capable of detecting the different wavelengths of light such that the individual LEDs can be separately controlled, any number of LEDs can be used. The minimum number of LEDs is two. In this regard, it should be noted that color schemes that utilize 4 colors are known in the printing arts.

In addition, the present invention is not limited to LEDs as the light generators. Any light generator that provides an output spectrum that can be monitored can be used. For example, lasers could replace the LEDs discussed above.

The above-described embodiments utilize a feedback controller that adjusts the control signals for the LEDs until the monitor signals from the feedback LEDs match the target signals. However, the feedback controller can use other algorithms in which the control signals are adjusted until the monitor signals from the feedback LEDs have some other fixed relationship to the target signals. For example, the target light source, in general, will have a different intensity than the intensity of light being generated by the LEDs. The goal of the feedback controller in such a case is usually to match the color of the target and LED light sources. Hence, the feedback controller could adjust the LED control signals until the ratios of the target values to each other or to the overall target light intensity is the same as the corresponding ratios of the signals from the feedback LEDs.

The above-described embodiments of the present invention utilize an intensity control scheme in which the duty cycle of the LEDs is varied to vary the intensity of light generated by the light source. However, the present invention could also be applied to light sources in which the intensity of light generated by each LED is altered to alter the intensity of the light source.

Various modifications to the present invention will become apparent to those skilled in the art from the foregoing description and accompanying drawings. Accordingly, the present invention is to be limited solely by the scope of the following claims.

What is claimed is:

1. A light source comprising:

a light generator that generates a first light signal of a first wavelength and a first intensity that is set by a first control signal and a second light signal at a second wavelength and a second intensity that is set by a second control signal;

a light monitor that generates a first monitor signal having an amplitude determined by said first intensity and a second monitor signal having an amplitude determined by said second intensity;

a target signal generator having a port for receiving a target light signal, said target signal generator generating a first target signal having an amplitude indicative of a first target value and a second target signal having an amplitude indicative of a second target value from said target light signal;

a feedback controller that generates said first and second control signals such that said first and second monitor signals have a fixed relationship to said first and second target signals, respectively.

2. The light source of claim 1 wherein said feedback controller comprises a memory for storing a plurality of first and second target entries and wherein said first and second target values are chosen from said plurality of first and second target entries in response to a target value select signal.

3. The light source of claim 2 wherein said target value select signal causes said feedback controller to utilize a sequence of first and second target values that changes as a function of time.

4. The light source of claim 1 wherein said first and second target values are periodically determined from said target light signal.

5. The light source of claim 1 wherein said light generator comprises first and second LEDs for generating said first and second light signals, respectively.

6. The light source of claim 1 wherein said light generator comprises first and second lasers for generating said first and second light signals, respectively.

7. The light source of claim 1 wherein said feedback controller comprises a memory for storing said first and second target values, said feedback controller causing said first and second target values to be generated from said target light signal and stored in said memory in response to a calibration control signal being received by said feedback controller.

8. The light source of claim 1 wherein said target signal generator port is positioned so as to cause said target light signal to illuminate said light monitor and wherein said feedback controller comprises a memory for storing said first and second target values, and wherein said target signal generator causes said feedback controller to generate said first and second target values from said first and second monitor signals and to store said first and second target values in said memory during a period of time in which said light generator is not generating light.

9. A light source comprising:

a light generator that generates a first light signal of a first wavelength and a first intensity that is set by a first control signal and a second light signal at a second wavelength and a second intensity that is set by a second control signal;

a light monitor that generates a first monitor signal having an amplitude determined by said first intensity and a second monitor signal having an amplitude determined by said second intensity;

a target signal generator having a port for receiving a target light signal, said target signal generator generating a first target signal having an amplitude indicative of a first target value and a second target signal having an amplitude indicative of a second target value from said target light signal;

a feedback controller that generates said first and second control signals such that said first and second monitor signals have a fixed relationship to said first and second target signals, respectively;

wherein said light monitor comprises a first monitor photodetector that generates a signal having a first functional relationship to the intensity of light received by said first monitor photodetector at said first wavelength and wherein said target signal generator comprises a first target photodetector that generates a signal having said first functional relationship to the intensity of light received by said first target photodetector at said first wavelength.

10. The light source of claim 9 wherein said light monitor further comprises a second monitor photodetector that generates a signal having a second functional relationship to the intensity of light received by said second monitor photodetector at said second wavelength and wherein said target signal generator further comprises a second target photodetector that generates a signal having said second functional relationship to the intensity of light received by said second target photodetector at said second wavelength.

11. The light source of claim 9 wherein said first monitor photodetector and said first target photodetector comprise identical optical filters for blocking at least a portion of light of said second wavelength from reaching said first monitor photodetector and said first target photodetector.

12. The light source of claim 9 wherein said feedback controller includes calibration values relating said first monitor signal to said first target signal when said first monitor photodetector and said first target photodetector are exposed to a calibration light source.

13. A method for controlling a light source that generates a first light signal of a first wavelength and a first intensity that is set by a first control signal and a second light signal at a second wavelength and a second intensity that is set by a second control signal, said method comprising:

monitoring said first and second light signals to generate first and second monitor light signals having amplitudes determined by said first and second intensities, respectively;

adjusting said first and second control signals such that said first and second monitor signals have a fixed relationship to said first and second target signals, respectively, wherein said first and second target signals are generated from first and second target values that are generated by exposing said light source to a target light signal.

14. The method of claim 13 wherein said light source comprises a monitor circuit for monitoring said first and second light signals and wherein said monitoring circuit is exposed to said target light signal to generate said first and second target values.

15. The method of claim 13 wherein said first and second target values are stored in said light source after exposing said light source to said target light signal.

* * * * *